US006684178B2

(12) United States Patent
DeRose et al.

(10) Patent No.: US 6,684,178 B2
(45) Date of Patent: Jan. 27, 2004

(54) SYSTEMS AND METHODS FOR MONITORING THE USAGE AND EFFICIENCY OF AIR COMPRESSORS

(75) Inventors: Lynn-Ann DeRose, Gloversville, NY (US); Srinivas Krishnashany Bagepalli, Niskayuna, NY (US); Joseph James Salvo, Niskayuna, NY (US); Richard Karl Hansen, Latham, NY (US); Janet Sue Bennett, Scotia, NY (US); Rose Alice Hanzlik, Chagrin Falls, OH (US); Evelyn Tackla Malloy, Hudson, OH (US)

(73) Assignee: General Electric Company, Niskayuna, NY (US)

( * ) Notice: Subject to any disclaimer, the term of this patent is extended or adjusted under 35 U.S.C. 154(b) by 148 days.

(21) Appl. No.: 09/681,801

(22) Filed: Jun. 7, 2001

(65) Prior Publication Data

US 2002/0188422 A1 Dec. 12, 2002

(51) Int. Cl.[7] ..... G08B 21/00; G06F 19/00

(52) U.S. Cl. ..... 702/182; 340/635; 340/679; 702/184

(58) Field of Search ..... 702/182, 33, 34, 702/35, 36, 183, 184, 185, 188; 340/635, 679

(56) References Cited

U.S. PATENT DOCUMENTS 6,102,665 A * 8/2000 Centers et al. ..... 417/18
6,330,525 B1 * 12/2001 Hays et al. ..... 702/183
6,438,484 B1 * 8/2002 Andrew et al. ..... 701/100
2001/0048376 A1 * 12/2001 Maeda et al. ..... 340/870.17
2002/0082810 A1 * 6/2002 Takahashi et al. ..... 702/188
2002/0095269 A1 * 7/2002 Natalini et al. ..... 702/188
2002/0173929 A1 * 11/2002 Seigel ..... 702/130
2002/0189267 A1 * 12/2002 Singh et al. ..... 62/126
2003/0014219 A1 * 1/2003 Shimizu et al. ..... 702/184

OTHER PUBLICATIONS

Parekh, "Investment—Grade Compressed Air System Audit, Analysis, and Upgrade in a Pulp & Paper Mill", Apr. 2000.*

Parekh, "Beyond Air Leaks—How to Do compressed Air Systems Analysis?", Dec. 1998.*

* cited by examiner

*Primary Examiner*—Patrick Assouad
(74) *Attorney, Agent, or Firm*—Penny A. Clarke; Patrick K. Patnode

(57) ABSTRACT

Systems and methods for monitoring the efficiency characteristics and performance statistics of an air compressor system, comprising, an air compressor system, an air compressor system monitoring module operable for receiving input data and sending results data, the monitoring module having an analyzer for analyzing input data relating to air compressor system operation and generating output data relating to air compressor system performance and efficiency, and a communications network operably coupled to the air compressor system and air compressor system monitoring module, the communications network operable for acquiring the air compressor system data and for communicating the air compressor system data to the air compressor system monitoring module.

25 Claims, 5 Drawing Sheets

SYSTEMS AND METHODS FOR MONITORING THE USAGE AND EFFICIENCY OF AIR COMPRESSORS

BACKGROUND OF INVENTION

The present invention relates generally to computerized systems and methods for monitoring the usage and efficiency of industrial equipment and, more specifically, to computerized systems and methods for monitoring the usage, efficiency, and productivity of air compressors.

Compressed air is used in everything from automotive repair shops, to house painting applications, to industrial manufacturing facilities. Compressed air powers the tools that are used to build homes and paint automobiles. Compressed air is used in the cleaning of facilities and equipment, and as a carrier of materials and products.

The costs and energy associated with using compressed air are often overlooked. Despite the fact that the natural resource component of a compressed air system is free to anyone who wishes to use it, there are still costs associated with using air for certain purposes. While compressed air usage may be a significant operating cost, the fourth highest utility cost after electricity, natural gas, and water, most industries simply consider compressed air usage as a fixed cost. However, compressed air costs may be monitored and reduced just as the costs associated with, for example, recycling, raw material usage, and energy usage, may be monitored and reduced.

Compressed air's costs come with producing it in a compressor. Compressors require electricity to run them, tanks to hold the compressed air, hoses and valves, and a distribution system to move the air. By reducing the number of leaks in a compressor system, energy costs may be reduced while efficiency, performance, and productivity may be increased.

SUMMARY OF INVENTION

There is, accordingly, a need for systems and methods for monitoring compressed air usage, predicting compressed air usage, and for quickly gathering, formatting, and reporting compressed air usage data of a facility in order to optimize compressor efficiency. Efficiency is a measure of actual compressed air delivered to the system and the amount of horsepower required to deliver it. Productivity is measured as effective operation as measured by a comparison of production with cost, where cost is measured in terms of energy, time, and money. Productivity is defined as yielding results, benefits, or profits. The present invention meets these needs by implementing computerized systems and methods that allow a company to easily input production data and individual compressor related data and quickly obtain performance analysis results in order to maximize efficiency and reduce the costs associated with compressed air usage.

The present invention provides systems and methods for measuring the efficiency of compressed air systems in order to optimize that efficiency. The systems and methods of the present invention may be used by plant managers, engineers, etc. to measure the current state of their facilities' air compressor systems. The present invention analyzes data, calculates compressor efficiencies, analyzes facility and shift productivity, and analyzes variance in the air compressor systems. The present invention ranks compressors for overhaul, provides strategies for optimizing distribution systems, and calculates potential savings based on decreasing variance in the systems and optimizing compressor efficiency and overall plant productivity.

The present invention provides systems and methods for monitoring the efficiency characteristics and performance statistics of an air compressor system, comprising, an air compressor system, an air compressor system monitoring module operable for receiving input data and sending results data, the monitoring module having an analyzer for analyzing input data relating to air compressor system operation and generating output data relating to air compressor system performance and efficiency, and a communications network operably coupled to the air compressor system and air compressor system monitoring module, the communications network operable for acquiring the air compressor system data and for communicating the air compressor system data to the air compressor system monitoring module.

DETAILED DESCRIPTION

The term "six sigma" is used in and forms the background for the present application. The term "six sigma" defines an optimum measurement of quality: 3.4 defects per million events. The Greek letter sigma ($\sigma$) is a mathematical term that represents a measure of variation, the distribution or spread of data around the mean or average of any process or procedure in manufacturing, engineering, services, or transactions. The sigma value, or standard deviation, indicates how well a given process is performing. The higher the value, the fewer the defects per million opportunities. Six sigma is the application of statistical problem-solving tools that identifies where wasteful costs are located and points towards steps for improvement.

The present invention provides systems and methods for measuring the efficiency of an air compressor system. Efficiency is defined as effective operation as measured by a comparison of production with cost, where cost is measured in terms of energy, time, and money. In one embodiment of the present invention, the systems and methods for monitoring an air compressor system include an air compressor monitoring module including a plurality of predefined data files which are accessed via, for example, a webpage. For instance, such information may be obtained by a remote computer accessing a web server via the Internet. The web server may employ a plurality of data files displayed as a webpage layout and an active server page program to create a webpage that displays information. In an alternative embodiment of the present invention, the plurality of predefined data files may be included in a software application residing in a computer system.

Figure 1:
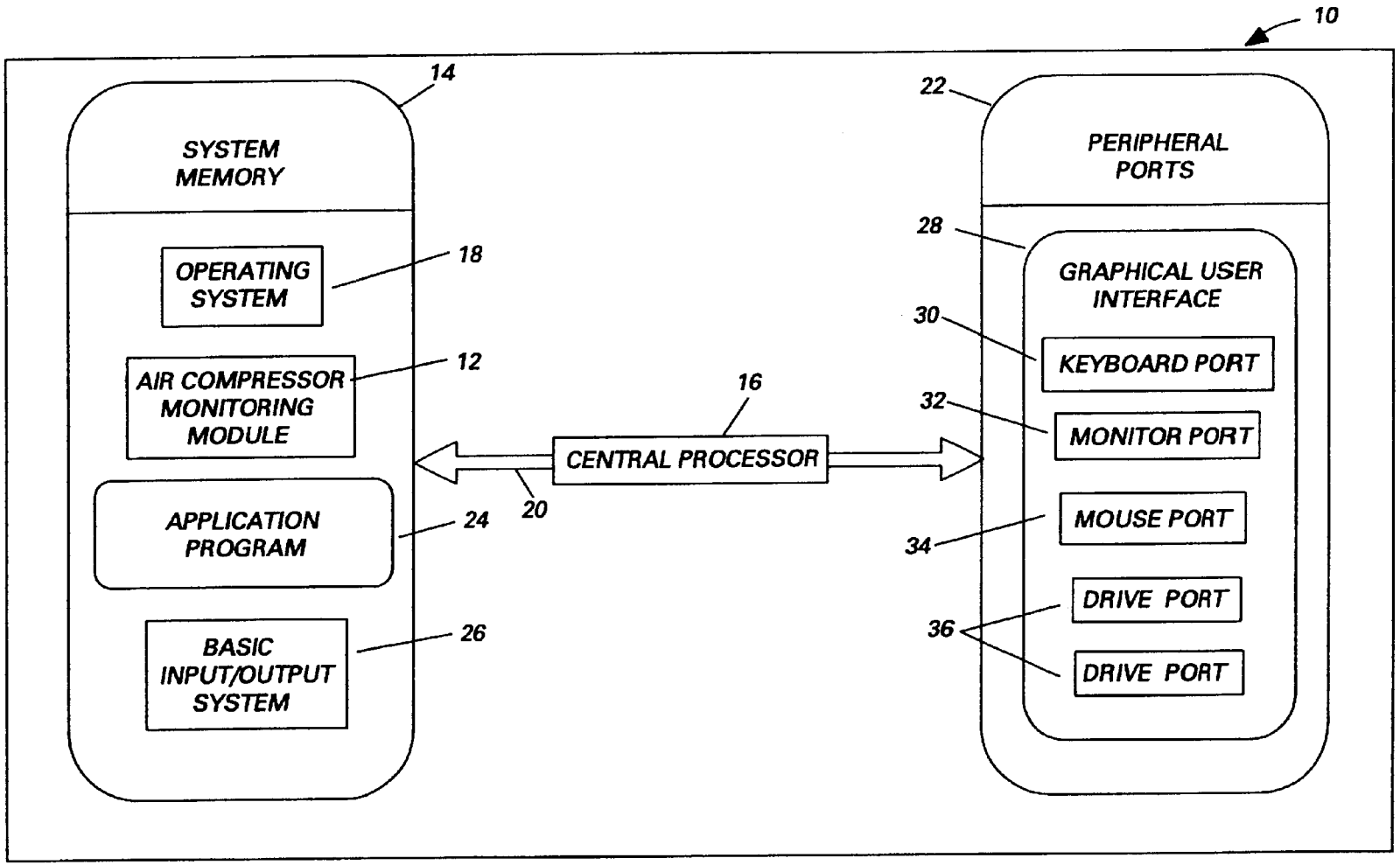
FIG. 1 is a functional block diagram of a compressed air system monitoring module residing in a computer system.
Figure 2:
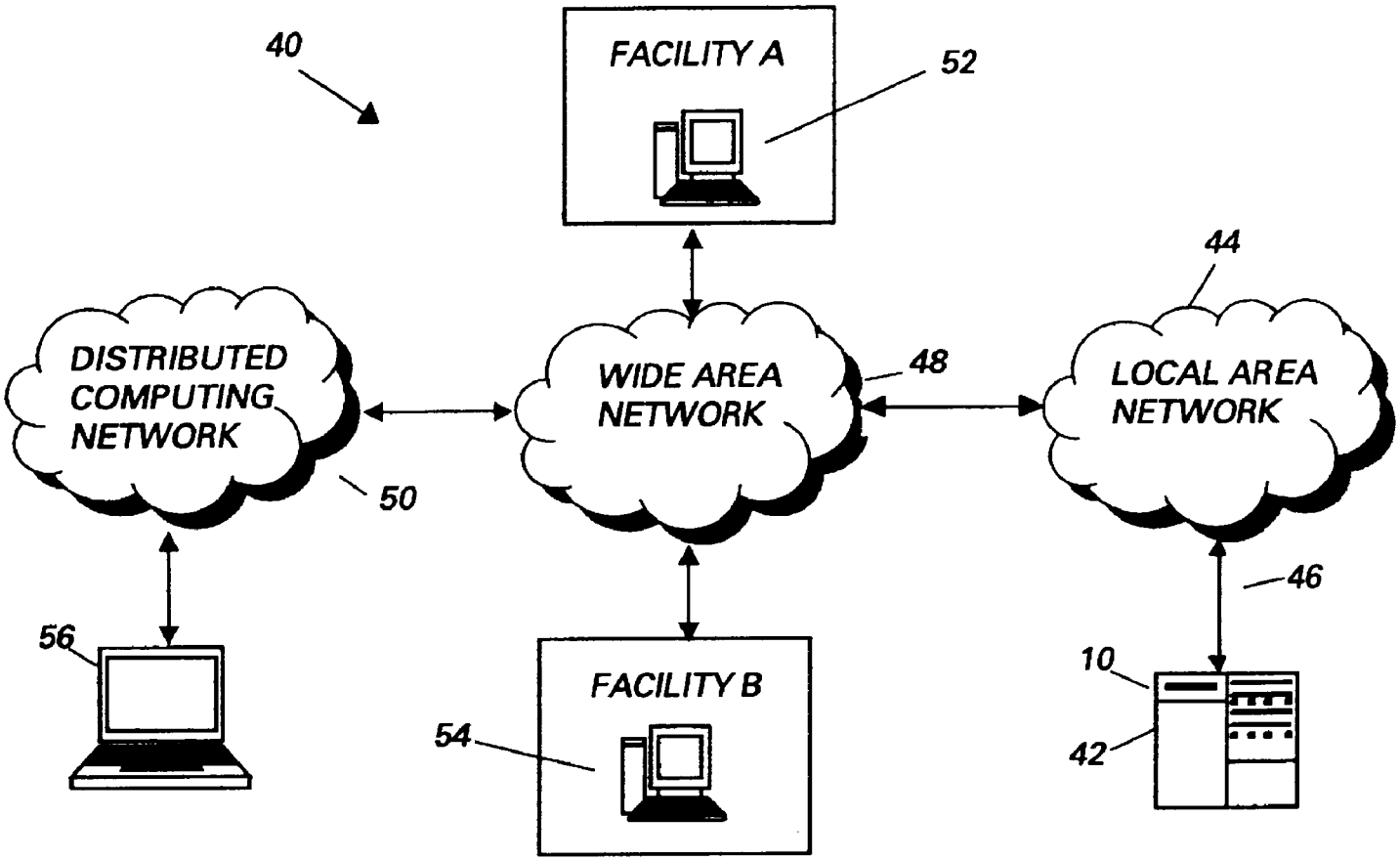
FIG. 2 is a functional block diagram of a communications network further representing an operating environment for the air compressor monitoring module of FIG. 1.

FIGS. 1 and 2, in one embodiment, depict a computer system 10 and an operating environment used for measuring the efficiency of a facility's air compressor system in order to optimize the productivity of that air compressor system. Productivity is a measure of effective operation as measured by a comparison of production with cost. Cost may be measured in terms of energy, time, and money. Efficiency is a measure of the actual air delivered compared to the energy required to produce it.

The computer system 10 acquires air compressor system information and predicts air compressor efficiency. As those skilled in the art of computer programming recognize, computer programs are depicted as processes and symbolic representations of computer operations. Computer components, such as a central processor, memory devices, and display devices, execute these computer operations. The computer operations include the manipulation of data bits by the central processor, and the memory devices maintain the data bits in data structures. The processes and symbolic representations are understood, by those skilled in the art of computer programming, to convey the discoveries in the art.

FIG. 1 is a functional block diagram showing one possible embodiment of the present invention, in which an air compressor monitoring module 12 resides within a computer system 10. The air compressor monitoring module 12 may be stored within a system memory device 14. The computer system 10 also includes a central processor 16 executing on an operating system 18. The operating system 18 also resides within the system memory device 14. The operating system 18 includes a set of instructions that control the internal functions of the computer system 10. A system bus 20 communicates signals, such as data signals, control signals, and address signals, between the central processor 16, the system memory device 14, and at least one peripheral port 22. Those of ordinary skill in the art understand that the program, processes, methods, and systems described in this application are not limited to any particular computer system or computer hardware.

Those skilled in the art also understand that the central processor 16 is typically a microprocessor. Advanced Micro Devices, Inc., for example, manufactures a full line of ATHLON™ microprocessors (ATHLON™ is a trademark of Advanced Micro Devices, Inc., One AMD Place, P.O. Box 3453, Sunnyvale, Calif. 94088-3453, 408.732.2400, 800.538.8450, www.amd.com). Intel Corporation also manufactures a family of X86 and P86 microprocessors (Intel Corporation, 2200 Mission College Blvd., Santa Clara, Calif. 95052-8119, 408.765.8080, www.intel.com). Other microprocessor manufacturers include Motorola, Inc. (1303 East Algonquin Road, P.O. Box A3309 Schaumburg, Ill. 60196, www.Motorola.com), International Business Machines Corp. (New Orchard Road, Armonk, N.Y. 10504, (914) 499-1900, www.ibm.com), and Transmeta Corp. (3940 Freedom Circle, Santa Clara, Calif. 95054, www.transmeta.com). While only one microprocessor is shown, those skilled in the art also recognize that multiple processors may be utilized. Those skilled in the art further understand that the program, processes, methods, and systems described in this application are not limited to any particular manufacturer's central processor.

The system memory 14 further contains an application program 24 and a Basic Input/Output System (BIOS) program 26. The application program 24 cooperates with the operating system 18 and with the at least one peripheral port 22 to provide a Graphical User Interface (GUI) 28. The Graphical User Interface 28 is typically a combination of signals communicated along a keyboard port 30, a monitor port 32, a mouse port 34, and one or more drive ports 36. The Basic Input/Output System 26, as is well known in the art, interprets requests from the operating system 18. The Basic Input/Output System 26 then interfaces with the keyboard port 30, the monitor port 32, the mouse port 34, and the drive ports 36 to execute the request.

The operating system 18 may be WINDOWS® (WINDOWS® is a registered trademark of Microsoft Corporation, One Microsoft Way, Redmond Wash. 98052-6399, 425.882.8080, www.Microsoft.com). WINDOWS® is typically preinstalled in the system memory device 14. Those of ordinary skill in the art also recognize that many other operating systems are suitable, such as UNIX® (UNIX® is a registered trademark of the Open Source Group, www.opensource.org), Linux, and Mac® OS (Mac® is a registered trademark of Apple Computer, Inc., 1 Infinite Loop, Cupertino, Calif. 95014, 408.996.1010, www.apple.com). Those skilled in the art again understand that the program, processes, methods, and systems described in this application are not limited to any particular operating system.

The air compressor monitoring module 12 may be physically embodied on or in a computer-readable medium, or may be stored as a web-site that is accessed via the Internet using a web browser Examples of computer-readable medium include: CD-ROM, DVD, tape, cassette, floppy disk, memory card, and a large-capacity disk (such as IOMEGA®, ZIP®, JAZZ®, and other large-capacity memory products) (IOMEGA®, ZIP®, and JAZZ® are registered trademarks of Iomega Corporation, 1821 W. Iomega Way, Roy, Utah 84067, 801.332.1000, www.iomega.com). The computer-readable medium, or media, could be distributed to end-users, licensees, and assignees. These types of computer readable media, and other types not mentioned here but considered within the scope of the present invention, allow the air compressor monitoring module 12 to be easily disseminated. A computer program product for tracking, monitoring, and reporting air compressor efficiency comprises a computer-readable medium and the air compressor monitoring module 12. The air compressor monitoring module 12 communicates information over a communications network.

FIG. 2 is a functional block diagram of a communications network 40. This communications network 40 further represents an operating environment for the air compressor system monitoring module 12 (FIG. 1). The air compressor monitoring module 12 resides within the memory storage device 14 (FIG. 1) in the computer system 10. The computer system 10 is shown as a server 42. The server 42 may communicate with a Local Area Network (LAN) 44 along one or more data communication lines 46. As those of ordinary skill understand, the Local Area Network 44 is a grid of communication lines through which information is shared between multiple nodes. These multiple nodes are conventionally described as network computers. As those of ordinary skill in the art also recognize, the Local Area Network 44 may itself communicate with a Wide Area Network (WAN) 48 and with a globally-distributed computing network 50, such as the Internet. The communications network 40 allows the server 42 to request and acquire information from many other computers connected to the Local Area Network 44, the Wide Area Network 48, and the globally-distributed computing network 50.

Referring to FIG. 2, the server 42 may communicate/acquire information to/from many computers connected to the communications network 40. The server 42, for example, may acquire air compressor system information from a predetermined facility A computer 52 monitoring an air compressor system. The server 42 may also acquire air compressor information from a different facility B computer 54 monitoring, for example, a product manufacturing plant or process that requires the use of compressed air to produce a specific manufactured product.

It is also possible for a user or operator having an interest in the air compressor system to use a remote computer 56 to access the communications network 40 and to remotely access the server 42, the facility A computer 52, and the facility B computer 54. Because many computers may be connected to the communications network 40, computers and computer users may share and communicate a vast amount of information acquired and processed by the air compressor monitoring module 12 (FIG. 2). The air compressor monitoring module 12 thus permits on-line, real-time air compressor system monitoring.

Figure 3:
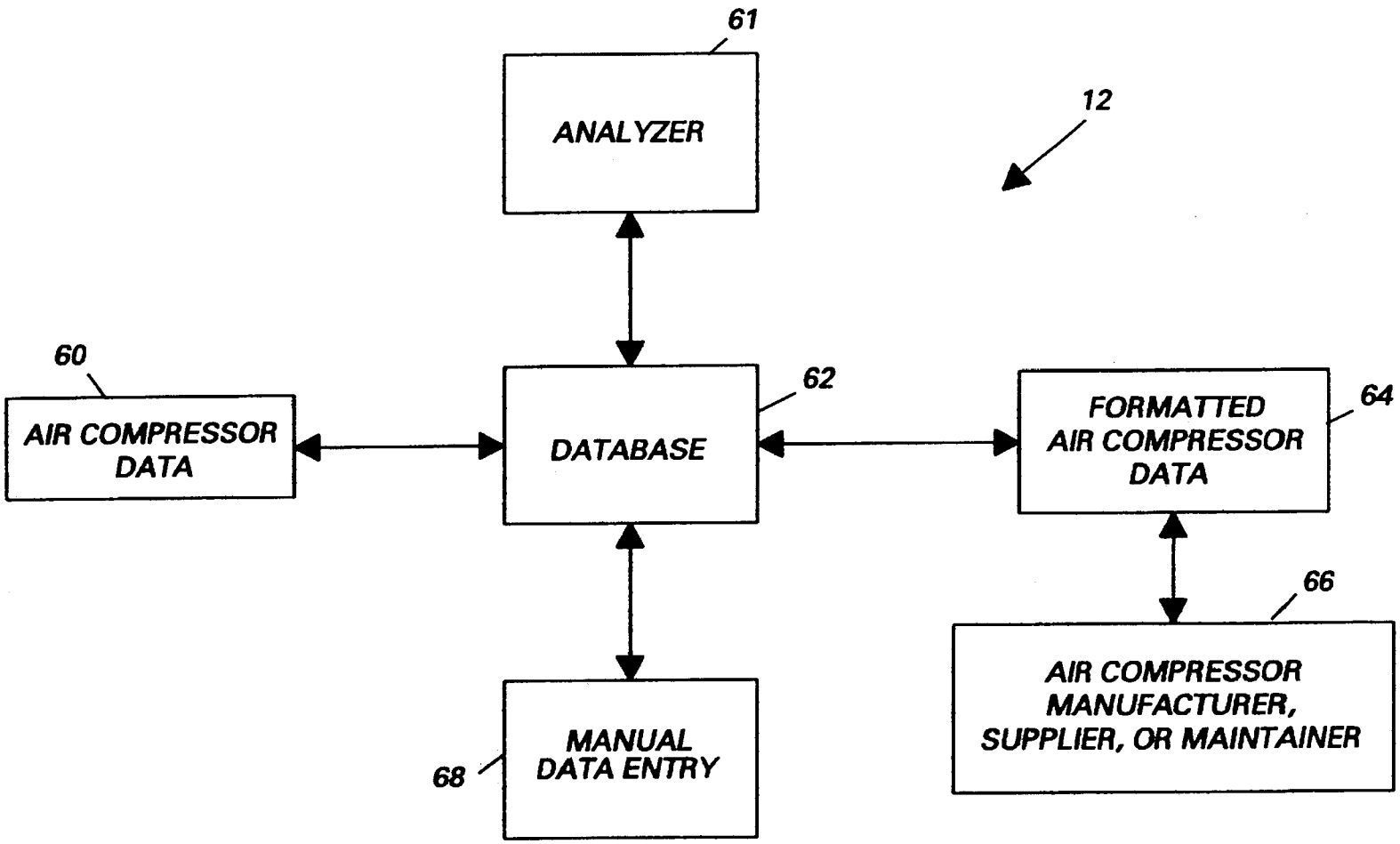
FIG. 3 is a functional block diagram of one embodiment of the air compressor monitoring module of the present invention.

FIG. 3 is a functional block diagram illustrating one embodiment of the air compressor monitoring module 12. The air compressor monitoring module 12 acquires information from the communications network 40 (FIG. 2), or directly from an air compressor system and uses this information to track and predict air compressor usage and efficiency for, for example, commercial buildings or for industrial facilities. As FIG. 3 illustrates, the air compressor monitoring module 12 acquires air compressor system information 60 and stores this information in a database 62. The air compressor system information 60, for example, may relate to an air compressor being used in a product manufacturing plant. The air compressor usage information 60 may also relate to an air compressor used in any portion, area, or machine of an industrial process. The air compressor system information 60, likewise, may relate to an air compressor being used in a particular room, in similar applications at different facilities for comparison, and in an entire facility as a whole. Further, the air compressor monitoring module 12 may acquire air compressor system information 60 from multiple locations. The air compressor system information may include data such as compressor identification, owner identification, activity logs identifying compressor usage, energy logs identifying energy usage and cost, reference compressor data based on a make or model of a compressor, raw data info (described in more detail below), and combinations of and associations between such data. This air compressor system information 60 may be used by an analyzer 61 to track and predict historical, present, and future air compressor system conditions from those multiple locations. The analyzer 61 may include, for example, software having data analyzing and forecasting capabilities. The air compressor monitoring module 12 supplies air compressor system profiles that help plant operators, owners, and other employees understand the consequences of using inefficient air compressor systems.

The air compressor monitoring module 12 may also report air compressor system data to suppliers, manufacturers, or maintainers 66 of air compressor systems. As FIG. 3 illustrates, the air compressor system monitoring module 12 may communicate with a supplier, manufacturer, or maintainer 66 of the air compressor system to send and receive statements, usage reports, dry air quality reports, and other air compressor related information. The air compressor monitoring module 12 may communicate formatted air compressor system data 64 along the communications network, in real-time and on-line, to an air compressor system supplier, manufacturer, or maintainer. The air compressor system monitoring module 12 may include a plurality of sensors connected to the air compressor system, the plurality of sensors operable for directly inputting data into the air compressor monitoring module 12. The air compressor monitoring module 12 may further accept manually-entered data 68 from plant operators, engineers, and others with access to the database 62 or with access to the network. The air compressor monitoring module 12 thus reduces, and may even eliminate, the need for plant personnel to monitor and report air compressor system information. The reporting of system data to manufacturers and suppliers of the systems may facilitate the repair and service of air compressor systems that are not running at optimum efficiencies. The reported results may lead to pulling an air compressor off-line or possibly changing its mode of operation.

Figure 4:
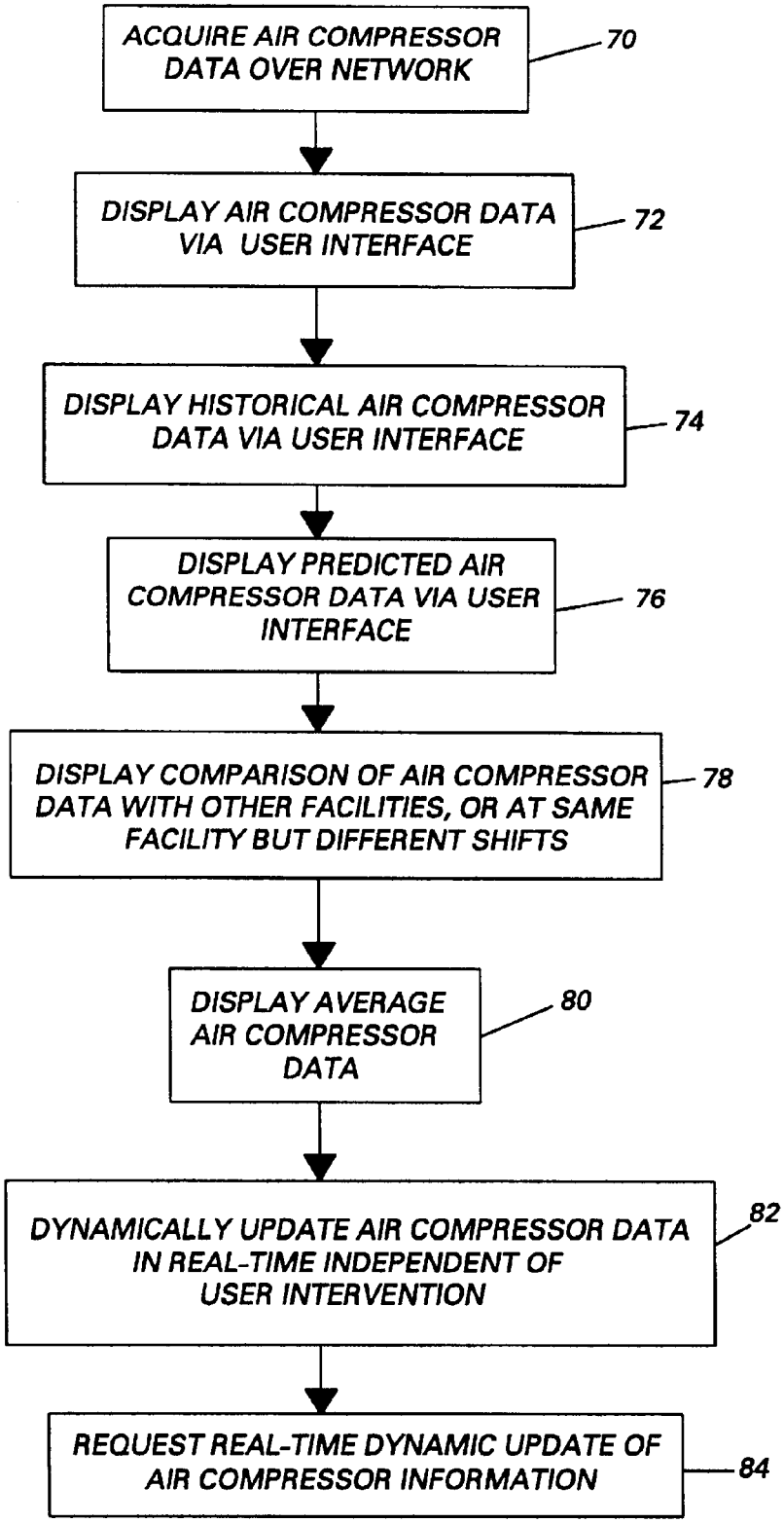
FIG. 4 is a flowchart of a method for acquiring air compressor data over a communications network.

FIG. 4 is a flowchart of a method for acquiring air compressor information over a communications network. Air compressor data may be acquired in real-time or at a later time, over the communications network from a computer, automatically or by manual entry (Block 70). The air compressor information may be displayed via a user interface on the computer (Block 72). Historical air compressor efficiency (Block 74) and predicted air compressor efficiency (Block 76) for the facility may be displayed via the user interface. A comparison between an air compressor used at a given facility and an air compressor used at a different facility may also be displayed (Block 78), or a comparison of a single air compressor used at a single facility during different shifts (Block 78) may also be displayed. Average air compressor efficiency for the facility may also be displayed (Block 80). The methods and systems of the present invention may also dynamically update the acquired air compressor information in real-time, independent of any intervention by a human user (Block 82). A user may also request an update of air compressor efficiency information in real-time (Block 84). It should be noted that the systems and methods described herein may be utilized to generate and output any user-defined manipulation of the compressor system information.

Figure 5:
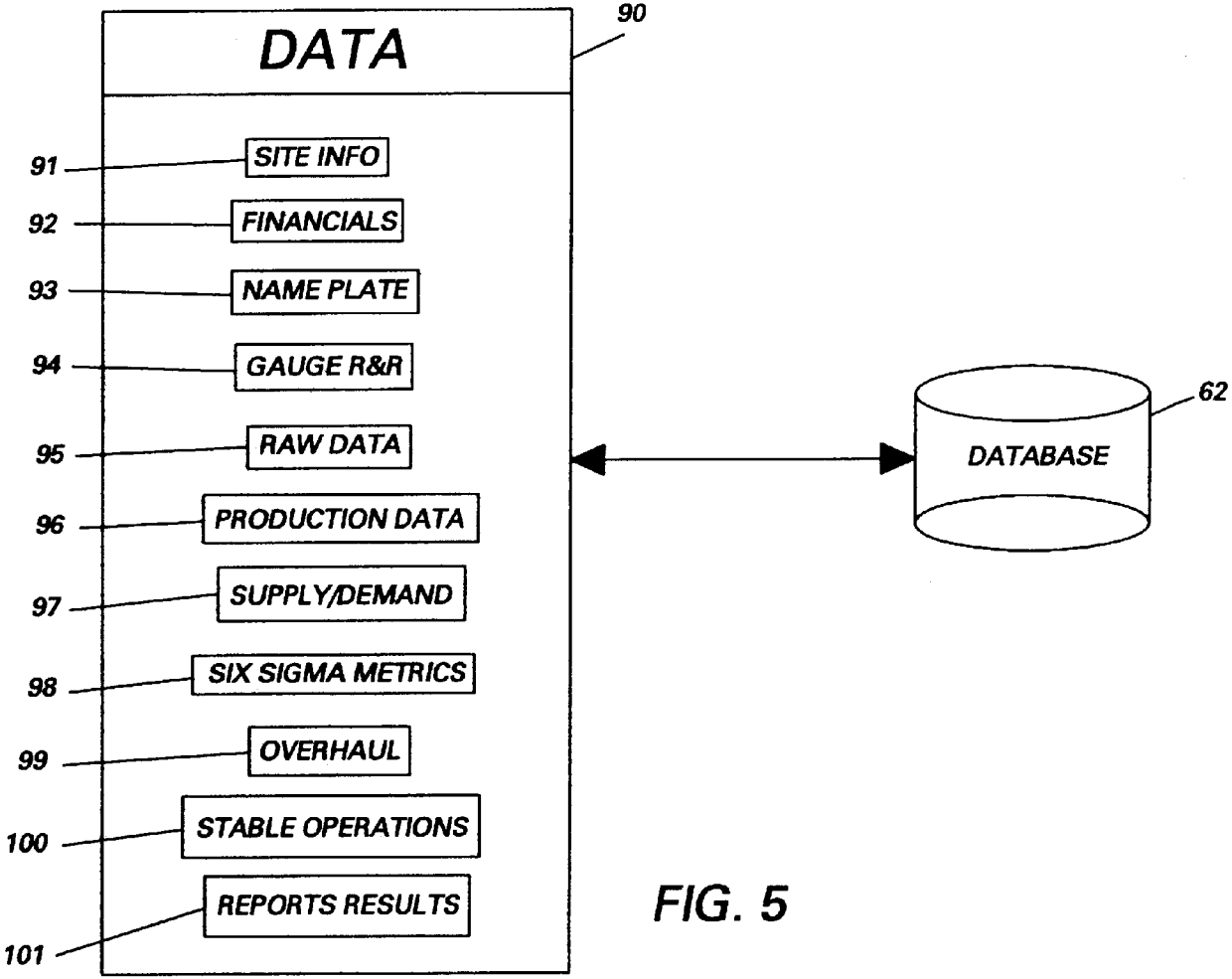
FIG. 5 is a functional block diagram of a plurality of data sheets stored in a database that are components of the air compressor monitoring module.

Referring to FIG. 5, the air compressor module 12 (FIGS. 1 and 2) includes a plurality of data files 90 that include input data or results data used to analyze an air compressor system. The data may be manually gathered and input into the system, such as though using a data-recording sheet, or the data may be automatically transmitted through the network. The input files contain efficiency characteristics and production information necessary to collect data, analyze data, and calculate results. The results data contains suggested optimization processes, such as air compressor system maintenance, replacement, usage, etc., for the air compressor system that is being analyzed. The results data further include optimization suggestions which lead to increased efficiency of a given system and potential savings. The data files 90 include instructions for completion, spaces for inputting data, and tabs for selecting features, as described in more detail below.

In one embodiment, input data for the module 12 may include: site information, financials, name plate information, gauge repeatability and reproducibility (R&R), raw data, production data, and supply/demand data. Results data for the module may include: six sigma metrics, overhaul options, stable operating conditions, and reports. All input data and results data may be stored in a database for further queries. The module also may allow for multiple compressor records to be input.

The site information input data 91 may include contact and reference information regarding a given site and the audit, such as site location, address, date of audit, site contact, phone numbers, e-mail addresses, auditor contact, auditor contact phone number, and the auditor contact's e-mail address. This information may also be used as a cover sheet for a final report.

The financial input data 92 may include costs associated with electricity, water, mode of operation, hours of operation per shift, number of shifts per day, number of days in operation per year, pressure, amperage, cubic feet per minute, temperature, and flow. Pressure, temperature, and amperage are variables that are needed to calculate air compressor system flow. Energy, required in horsepower (HP) or kilowatts (KW), is used to calculate the efficiency of the compressor. The name plate information input data 93 includes the compressor name and number necessary for database queries. This data may include manufacturer rated conditions available on the name plate of a compressor. Also, this data may include the actual or estimated compressor performance under full load test conditions. Measured efficiency of a compressor at full load may be used to determine the efficiency of a compressor and whether or not maintenance may be required. The name plate information input data 93 may be utilized to calculate, compare, and report the rated efficiencies and actual efficiencies of a given compressor. The gauge repeatability and reproducibility input data 94 includes a measure of the variance of the compressor gauges as well as the variance of other devices used to measure the compressor. A data file is used to determine the gauge R&R for each instrument. The data file provides a short description regarding the importance of doing gauge R&R on a compressor and instrument. The gauge R&R data 94 is analyzed by the analyzer 61 to determine whether the instruments are within an acceptable gauge range for the air compressor system. Repeatability is the variation present when one person measures the same part several times with the same instrument. Reproducibility is the variation resulting from different operators measuring the same parts with the same gauge. Gauge error may be caused by an instrument, operator, fixture, instructions, etc. Measurements are used to understand and manage a process, therefore, it is imperative that gauge error be identified and quantified. An inspector/gauging system is not 100% efficient. A variance of the compressor gauges as well as the variance of the auditor instrumentation under 30% is preferred. A variance between about 10% to about 30% is more preferred. A variance below about 10% is even more preferred.

The raw data input 95 merges electric current and air flow data. To measure the efficiency of an air compressor during actual work conditions, an auditor must measure the electric current and air flow for each compressor. Air flow is calculated from pressure and temperature. To do an efficiency calculation, the files must be combined, matching dates and times. The merged files are then stored on the database for further analysis and queries. The production data 96 is analyzed by the analyzer 61 to calculate productivity (units/KW) and variability in productivity between shifts, lines, days, weeks, etc. using a predetermined standard of acceptability. For each date there may be a plurality of shifts which use the same air compressor system, and for each shift, multiple groups can be added. The total production per shift can be used depending on variations in shifts and lines.

The supply/demand input data 97 measures the required flow of major users on the distribution side of the air compressor system. The actual flows on the supply side are measured and inputted to determine if there is a deficit or a surplus of compressed air in the system. Distribution systems may be optimized based on supply/demand data. Often, higher pressure is delivered than is actually required, which results in a greater supply than there is a demand for. The air compressor system monitoring module shows what is actually required.

The analyzer 61 predicts six sigma metrics 98 on compressor efficiencies and productivity. The mean (average efficiency or productivity), standard deviation, $Z_{lt}$ (sigma long-term), Ppk (measurement for short-term capability), and Cpk (measurement for long-term capability) are calculated for a given compressor's efficiency and productivity. The overhaul data 99 is analyzed by the analyzer 61 to rank each compressor for overhaul based on $Z_{lt}$ and variance. The compressor with the highest variance and the smallest $Z_{lt}$ value is the first to be overhauled. Overhaul options may include repair or replacement of seals, lines, motors, lubricants, nozzles, etc. Voltage, power, and temperature are used in daily efficiency calculations and are needed to recommend an overhaul sequence based on variability during daily operation. Savings based on restoring the compressor to the manufacturers ratings are then calculated and reported. The stable operations data 100 is analyzed by the analyzer 61 to determine savings based on running each air compressor system and work shift at its "best in class", where "best in class" is a predetermined standard of quality based on air compressor system performance. To determine "best in class" for each shift, daily power consumption, total units produced, and productivity are measured. Optimum power is calculated based on the "best in class" for each shift. Projected savings are calculated based on the shift operating at the "best in class" each day and these savings are rolled up to total savings per year. The reports results data 101 allows for the viewing and printing of each of the printable reports that are created. Results may be displayed for efficiency, productivity, and stable operations. Data from these forms may be recalculated depending on whether modifications were made to input data. A form is recalculated whenever data pertaining to results is edited. Depending on the number of compressors, the amount of data, and the speed of the computer, calculations may take several seconds. However, this data is saved into a database, so subsequent viewings have no time delay. Results are displayed in an easily readable format that relates efficiency to productivity and shows how much each specific product costs to produce.

The monitoring module of the present invention may also be used to monitor a gas flow distribution system or a water distribution system. These alternative systems operate basically the same way as an air compressor system, the only difference being the material that is being transported.

While the present invention has been described with respect to various features, aspects, and embodiments, those of ordinary skill in the art, and those unskilled, will recognize the invention is not so limited. Other variations, modifications, and alternative embodiments may be made without departing from the spirit and scope of the present invention.

What is claim is:

1. A system for monitoring the efficiency characteristics and performance statistics of an air compressor system, the monitoring system comprising:

an air compressor system;

an air compressor system monitoring module operable for receiving input air compressor system data and sending air compressor system data, the monitoring module having an analyzer for analyzing input data relating to air compressor system operation and generating output data relating to air compressor system performance and efficiency;

a communications network operably coupled to the air compressor system and air compressor system monitoring module, the communications network operable for acquiring the air compressor system data and for communicating the air compressor system data to the air compressor system monitoring module;

a plurality of webpages for displaying the input air compressor system data and the output data relating to air compressor system performance and efficiency;

a module for reporting the air compressor system data to suppliers, manufacturers and maintainers of the air compressor system; and at least one sensor;

wherein the plurality of webpages are accessed via a web browser.

2. The system of claim 1, wherein the air compressor monitoring module further comprises a module operable for comparing the data to historical air compressor system data, air compressor system data obtained during different work shifts, air compressor system data obtained from varying environmental temperatures and pressures, and air compressor system data obtained from multiple facilities.

3. The system of claim 1, wherein the air compressor monitoring module further comprises a module operable for predicting future air compressor efficiency characteristics and productivity statistics based upon the data.

4. The system of claim 1, wherein the air compressor system input data further comprises site and audit reference information.

5. The system of claim 1, wherein the air compressor system input data further comprises financial data and costs associated with operating the air compressor system.

6. The system of claim 1, wherein the air compressor system input data further comprises compressor performance statistics.

7. The system of claim 1, wherein the air compressor system input data further comprises data relating to variance in compressor gauges and instrumentation.

8. The system of claim 1, wherein the air compressor system input data further comprises data gathered during different shifts and time periods.

9. The system of claim 1, wherein the air compressor system input data further comprises supply/demand data.

10. The system of claim 1, wherein the air compressor system output data further comprises compressor overhaul options.

11. The system of claim 1, wherein the air compressor system output data further comprises efficiency characteristics, productivity statistics, and cost savings results.

12. The system of claim 1, wherein the air compressor system input data is manually entered into the air compressor system monitoring module.

13. The system of claim 1, wherein the air compressor system is connected to a plurality of sensors, the plurality of sensors operable for directly inputting data into the air compressor monitoring module.

14. The system of claim 1, wherein the air compressor monitoring module resides within a memory storage device of a computer system.

15. A method for monitoring the efficiency characteristics and performance statistics of an air compressor system, the monitoring method comprising:

receiving air compressor system data related to the air compressor system;

processing, analyzing, and calculating air compressor efficiency characteristics and productivity statistics based upon the air compressor system data;

comparing the air compressor efficiency characteristics and the productivity statistics to historical air compressor system data, air compressor system data obtained during different work shifts, air compressor system data obtained from varying environmental temperatures and pressures, and air compressor system data obtained from multiple facilities;

predicting future air compressor efficiency characteristics and productivity statistics;

reporting air compressor system results data based on the air compressor system efficiency characteristics and the productivity statistics, in order to maximize efficiency and productivity; and displaying the air compressor system data, the air compressor efficiency characteristics, the productivity statistics, and the air compressor system results data using a plurality of webpages which are accessed via a web browser.

16. The method of claim 15, wherein the air compressor system data further comprises site and audit reference information.

17. The method of claim 15, wherein the air compressor system data further comprises financial data and costs associated with operating the air compressor system.

18. The method of claim 15, wherein the air compressor system data further comprises compressor performance statistics.

19. The method of claim 15, wherein the air compressor system data further comprises data relating to variance in compressor gauges and instrumentation.

20. The method of claim 15, wherein the air compressor system data further comprises data gathered during different shifts and time periods.

21. The method of claim 15, wherein the air compressor system data further comprises supply/demand data.

22. The method of claim 15, wherein the air compressor system results data further comprises compressor overhaul options, strategies for optimizing distribution system, and potential cost savings based on decreasing variance in the air compressor systems.

23. The method of claim 15, wherein the air compressor system data is manually entered into the air compressor system monitoring module.

24. The method of claim 15, wherein the air compressor system is connected to a plurality of sensors, the plurality of sensors operable for directly inputting data into the air compressor monitoring module.

25. The system of claim 15, wherein the air compressor monitoring module resides within a memory storage device of a computer system.

* * * * *

UNITED STATES PATENT AND TRADEMARK OFFICE

CERTIFICATE OF CORRECTION

PATENT NO. : 6,684,178 B2
DATED : January 27, 2004
INVENTOR(S) : Lynn-Ann DeRose et al.

It is certified that error appears in the above-identified patent and that said Letters Patent is hereby corrected as shown below:

Title page,
Item [75], Inventors, cancel "Krishnashany" and substitute -- Krishnaswamy --.

Signed and Sealed this

Eighth Day of June, 2004

JON W. DUDAS
*Acting Director of the United States Patent and Trademark Office*